US009993072B2

(12) United States Patent
Azkue et al.

(10) Patent No.: US 9,993,072 B2
(45) Date of Patent: Jun. 12, 2018

(54) SLIDING-PIVOTING MECHANISM OF A SHELF OF A PIECE OF FURNITURE OR OF A DOMESTIC APPLIANCE, PIECE OF FURNITURE, AND DOMESTIC APPLIANCE

(71) Applicant: PAUL HETTICH GMBH & CO. KG, Kirchlengern (DE)

(72) Inventors: Mikel Azkue, Zarautz (ES); Oscar Garcia, San Sebastian (ES); Eñaut Arriaga, Ordizia (ES); Iker Lopetegi, Zarautz (ES); Unai Laskibar, Zarautz (ES)

(73) Assignee: PAUL HETTICH GMBH & CO, KG., Kirchlengern (DE)

( * ) Notice: Subject to any disclaimer, the term of this patent is extended or adjusted under 35 U.S.C. 154(b) by 0 days. days.

(21) Appl. No.: 15/315,545

(22) PCT Filed: Jun. 3, 2015

(86) PCT No.: PCT/EP2015/062388
§ 371 (c)(1),
(2) Date: Dec. 1, 2016

(87) PCT Pub. No.: WO2015/185635
PCT Pub. Date: Dec. 10, 2015

(65) Prior Publication Data

US 2017/0181538 A1 Jun. 29, 2017

(30) Foreign Application Priority Data

Jun. 5, 2014 (DE) ..... 10 2014 107 962

(51) Int. Cl.
*F24C 15/16* (2006.01)
*A47L 15/50* (2006.01)
(Continued)

(52) U.S. Cl.
CPC ..... *A47B 46/005* (2013.01); *A47B 96/07* (2013.01); *A47L 15/506* (2013.01); *A47L 15/507* (2013.01); *F24C 15/168* (2013.01)

(58) Field of Classification Search
CPC .... A47L 15/504; A47L 15/506; A47L 15/507; A47B 46/005; F24C 15/16; F24C 15/168
See application file for complete search history.

(56) References Cited

U.S. PATENT DOCUMENTS 2,590,341 A * 3/1952 Nabholz ..... A47B 21/02 16/307
2,822,229 A * 2/1958 Carlson ..... A47B 77/12 248/586
(Continued)

FOREIGN PATENT DOCUMENTS

WO 2014033092 3/2014

OTHER PUBLICATIONS

International Search Report of PCT/EP2015/062392 dated Aug. 20, 2015.
(Continued)

*Primary Examiner* — Michael Safavi
(74) *Attorney, Agent, or Firm* — Barnes & Thornburg LLP

(57) ABSTRACT

A sliding-pivoting mechanism of a shelf includes a first pivot arm and a second pivot arm. The pivot arms are arranged attached to sidewalls of a body and parallel to each other at a distance from each other. A guide rail is fastened to second ends of the pivot arms in such a way that the guide rail can be pivoted parallel to the plane of the side walls and that the guide rail can be pivoted from a lower position space to a raised, upper position. The mechanism also includes at least one running rail, which can be moved linearly in the guide rail and to which the shelf is fastened. The sliding-pivoting mechanism includes a locking mechanism for pre-
(Continued)

venting a pivoting motion of the sliding-pivoting mechanism in a raised and a lowered end position. The locking mechanism is arranged on the guide rail and on one of the pivot arms and can be actuated by means of an activator fastened to the running rail.

13 Claims, 15 Drawing Sheets

(51) Int. Cl.
*A47B 46/00* (2006.01)
*A47B 96/07* (2006.01)

(56) References Cited

U.S. PATENT DOCUMENTS 2,919,966 A * 1/1960 Preston ..... A47B 21/02 126/337 A
3,081,138 A * 3/1963 Stebbins ..... A47B 46/00 312/319.3
3,466,108 A * 9/1969 Guth ..... A47L 15/506 126/340
3,799,640 A * 3/1974 Jacobs ..... A47L 15/506 312/273
4,134,629 A * 1/1979 Hansen ..... A47B 46/005 312/246
4,915,461 A * 4/1990 Kingsborough ..... A47B 77/10 312/247
5,115,822 A * 5/1992 Nichols ..... A47L 15/506 134/135
5,249,858 A * 10/1993 Nusser ..... A47B 46/005 312/248
5,308,158 A * 5/1994 Vogelgesang ..... A47B 46/005 211/170
5,971,513 A * 10/1999 Cassalia ..... A47L 15/506 312/272
6,247,771 B1 * 6/2001 Miller ..... A47L 15/506 312/272
7,621,605 B2 * 11/2009 Bond ..... A47B 46/00 312/311
7,731,805 B2 * 6/2010 Banta ..... A47L 15/506 134/56 D
7,770,986 B1 * 8/2010 Simaitis ..... A47B 46/005 312/246
8,424,693 B1 * 4/2013 Hoover ..... A47F 5/0062 211/126.15
8,424,983 B1 * 4/2013 Strauss ..... A47B 51/00 312/247
2004/0080245 A1 * 4/2004 Lammens ..... A47B 88/49 312/333
2004/0163687 A1 * 8/2004 Son ..... A47L 15/506 134/58 D
2005/0206282 A1 * 9/2005 Walburn ..... A47B 46/005 312/312
2006/0066189 A1 * 3/2006 Bond ..... A47B 46/00 312/319.1
2008/0129168 A1 6/2008 Banta et al.
2012/0074080 A1 * 3/2012 Garcia ..... A47B 46/005 211/41.9
2015/0002005 A1 * 1/2015 Park ..... A47L 15/507 312/228.1
2015/0305493 A1 * 10/2015 Garcia ..... A47B 46/005 211/86.01

OTHER PUBLICATIONS

English translation of International Search Report of PCT/EP2015/062392 dated Aug. 20, 2015.
Search Report issued in German Application No. 102014107962.0 dated May 12, 2015.

* cited by examiner

SLIDING-PIVOTING MECHANISM OF A SHELF OF A PIECE OF FURNITURE OR OF A DOMESTIC APPLIANCE, PIECE OF FURNITURE, AND DOMESTIC APPLIANCE

CROSS REFERENCE TO RELATED APPLICATIONS

This application is a U.S. nationalization under 35 U.S.C. § 371 of International Application No. PCT/EP2015/062388, filed Jun. 3, 2015, which claims priority to German Application No. 102014107962.0 filed Jun. 5, 2014.

BACKGROUND AND SUMMARY OF THE DISCLOSURE

The disclosure relates to a sliding-pivoting mechanism of a shelf of a piece of furniture or a domestic appliance for pulling out or raising the shelf from a body of the piece of furniture or from a useful space of a domestic appliance. The disclosure further relates to a piece of furniture as well as a domestic appliance with a sliding-pivoting mechanism.

Such sliding-pivoting mechanisms may be installed for facilitating the use of pieces of furniture or domestic appliances, especially dishwashers or cooking appliances. A shelf installed in such a piece of furniture or domestic appliance can be moved by means of a sliding-pivoting mechanism from a bottom position by pulling out and subsequent upward pivoting to an upward position in which a user can conveniently place items on the shelf or remove items placed on said shelf.

A generic sliding-pivoting mechanism is known for example from WO 2014/03 3092 A1.

The sliding-pivoting mechanism described there has proven its worth in practice.

It is problematic that when the shelf is subject to heavy loads, in particular, the locking of the sliding-pivoting mechanism in the upper position in which the shelf is positioned in the lifted position for convenient loading and unloading does not always occur in a reliable manner.

The present disclosure is directed to a sliding-pivoting mechanism in which the locking of the sliding-pivoting mechanism is improved.

The sliding-pivoting mechanism in accordance with the disclosure comprises a rotatably fixed first pivot arm which is fastened to at least one of the side walls of the furniture body or of the useful space by means of a first end parallel to the plane of the side walls and a second pivot arm which is rotatably fixed in the same manner. The two pivot arms are arranged in parallel at a distance from each other.

A guide rail is pivotably fastened to the respective second ends of the pivot arms parallel to the plane of the side walls in such a way that the guide rail can be pivoted from a bottom position within the furniture body or the useful space to a lifted, upper position at least partly outside the furniture body or the useful space. A shelf is fastened to a running rail which can be moved linearly in the guide rail.

A locking mechanism which is arranged on the guide rail and one of the pivot arms and can be actuated by an activator fixed to the running rail is further provided on the sliding-pivoting mechanism, which locking mechanism is used for preventing a pivoting movement of the sliding-pivoting mechanism in a lifted and a lowered end position.

The locking mechanism comprises a web, which is resiliently pivotably held on a first pivot arm, with a pin protruding in the direction of the guide rail, which pin can be guided along a guide element fixed to the guide rail from the locking position securing the lowered end position at least to the locking position securing the lifted end position.

The activator fixed to the running rail further comprises a curved guide, by which the pin, during the lifting and lowering of the shelf, can be guided from the locking position securing the lowered end position to the locking position securing the lifted end position and vice versa.

Such a curved guide provided in the activator facilitates the locking of the locking mechanism after the pivoting of the sliding-pivoting mechanism.

According to an embodiment, the curved guide is formed in such a way that the locking mechanism is automatically locked by a pivoting movement to the lifted end position and can be unlocked by an insertion movement against the pull-out direction.

This provides that unlocking can only occur by intentional insertion of the shelf and thus the running rail.

According to a further embodiment, the curved guide is formed on inner edges that delimit a cavity of the activator, comprising an inlet opening through which the pin can be guided into the cavity. The curved guide is thus housed in the interior of the activator and thus protected from outside damage.

According to an embodiment, the guide element comprises respective locking grooves in which the pin is disposed in the respective locking positions, wherein the locking grooves delimit a guide track of the guide element, along which the pin can be guided from one of the locking positions to the second one of the locking positions.

For the purpose of unlocking the sliding-pivoting mechanism from the first locking position, a first limit stop extending in the direction of the running rail is arranged on the activator in the region of the inlet opening, with which the pin can be moved from a position blocking a pivoting movement of the pivot arms and from the first locking groove during extension of the running rail in a pull-out direction, wherein the pin can be guided along the limit stop into the cavity during a subsequent pivoting movement of the pivot arms.

The limit stop allows simple unlocking of the sliding-pivoting mechanism from the lowered locking position, so that the shelf can only be pivoted upwardly in the nearly completely extended state.

The curved guide is formed according to a further embodiment in such a way that the pin, during the pivoting movement of the pivot arms, does not rest on any of the inner edges that delimit the cavity of the activator. The guidance of the pin occurs in this case along the guide track of the guide element.

In a further embodiment, the cavity comprises a slope on the edge at the pull-out side, which slope ascends from the inlet region to a vertically extending edge and with which the pin can be moved out of a position blocking a pivoting movement of the pivot arms in the second locking groove by pushing in the running rail against the pull-out direction.

As a result, the pin can be pressed upwardly along the ascending slope by intentional piecewise insertion of the shelf and thus the running rail, and can thus be moved out of the second locking groove, by means of which the pivoting movement of the sliding-pivoting mechanism is released again and the shelf can be pivoted downwardly.

According to an alternative embodiment, the curved guide is formed in such a way that the locking mechanism can be unlocked from the upper locking position by a pull-out movement of the running rail in the pull-out direction. The curved guide may be formed as a cardioid.

According to a further embodiment, an end stop for limiting the path of the running rail is formed at an end of the guide rail which is at the front in the pull-out direction in order to prevent that the running rail from being pushed too far out of the guide rail.

BRIEF DESCRIPTION OF THE DRAWINGS

FIGS. 5 and 6 show perspective views of the sliding-pivoting mechanism in a position in which the pivoting movement of the pivot arms is released, wherein FIG. 6 shows a detailed view of the section designated with VI in FIG. 5;

FIGS. 7 and 8 show perspective views, which correspond to FIGS. 5 and 6, of the sliding-pivoting mechanism during a pivoting movement, wherein FIG. 8 shows a detailed view of the section designated with VIII in FIG. 7;

FIGS. 9 and 10 show perspective views, which correspond to FIGS. 7 and 8, of the sliding-pivoting mechanism in a further progressed state of the pivoting shortly before reaching the lifted end position, wherein FIG. 10 shows a detailed view of the section designated with X in FIG. 9;

FIGS. 12 and 13 show illustrations, which correspond to FIGS. 9 and 10, of the sliding-pivoting mechanism during the release of the sliding-pivoting mechanism from the upper locking position, wherein FIG. 13 shows a detailed view of the section designated with XIII in FIG. 12;

DETAILED DESCRIPTION OF THE DRAWINGS

In the following description of the drawings, terms such as top, bottom, left, right, front, rear, etc. exclusively relate to the respective illustration and position of the sliding-pivoting mechanism, pivot arms, guide rail, running rail, activator and the like, which illustration and position are selected as examples in the illustrations. These terms are not to be understood as restrictive, i.e., these references may change in different operating positions or due to mirror-symmetric design or the like.

FIGS. 1 to 13 show an embodiment of a sliding-pivoting mechanism in accordance with the disclosure, wherein exemplary positions of the sliding-pivoting mechanism are shown during a lifting process and a subsequent lowering process.

Figure 1:
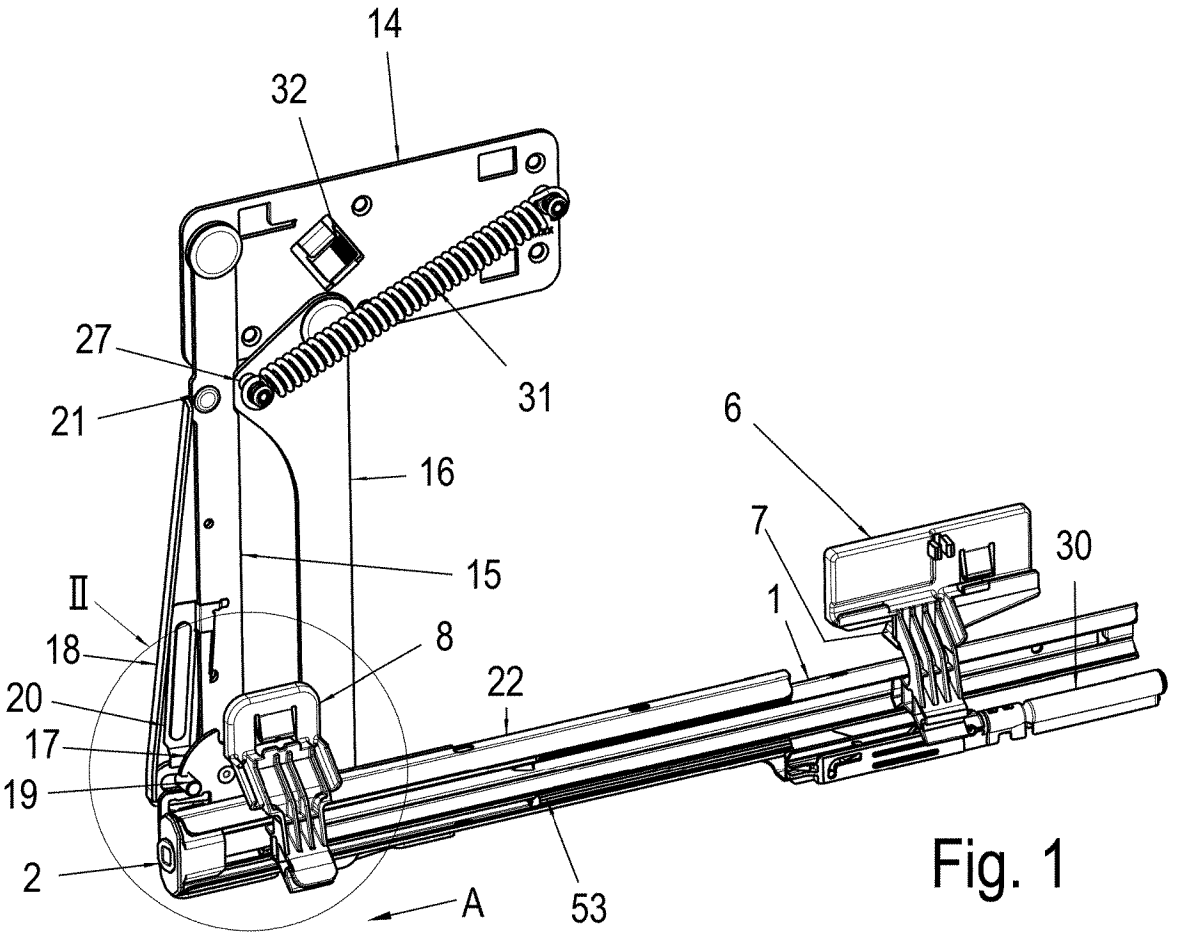
FIGS. 1 and 2 show a perspective view of an embodiment of a sliding-pivoting mechanism in accordance with the disclosure in the fully lowered position and a detailed view of the region designated with II in FIG. 1.

As is shown in FIG. 1 for example, the sliding-pivoting mechanism comprises two pivot arms 15, 16 which are arranged in parallel with respect to each other and spaced from each other.

The pivot arms 15, 16 are fastened with a first end via a pivot joint to a side wall retainer 14. The side wall retainer 14 may be mounted on a side wall of a piece of furniture or a domestic appliance such as a dishwasher. The inner wall of domestic appliances is also understood as a side wall.

Alternatively, the first ends of the pivot arms 15, 16 may be pivotally fastened directly to the side wall of the furniture item or the domestic appliance.

The second ends of the pivot arms 15, 16 which are spaced from the first ends are pivotably fastened to a guide rail 22 of a pull-out guide.

In addition to the guide rail 22, the pull-out guide comprises at least one running rail 1 which is linearly movable in the guide rail 22.

The running rail 1 may be coupled via a ball bearing to the guide rail 22. An end stop 53 on the guide rail is used for limiting the path of the running rail 1 in the guide rail 22. The end stop 53 interacts with the ball bearing. It can also be considered to provide other forms of end stops on different fixed or movable parts. At least one further movable rail can be arranged between the guide rail 22 and the running rail 1 in order to extend the pull-out.

A plug 2 may be arranged at the end of the running rail which is at the front in the pull-out direction A, which plug is used for limiting the path of the running rail 1 in the guide rail 22 against the pull-out direction.

An activator 6 and a fixing apparatus 8 are each fixed to the running rail 1 for fastening the shelf 34 to the sliding-pivoting mechanism, on which the shelf can be fastened and especially latched.

Details on the fastening of the shelf 34 to the activator 6 and the fixing apparatus 8 are described in closer detail in the aforementioned WO 2014/03 3092 A1, the disclosure of which is incorporated herein by reference for explaining numerous details of the sliding-pivoting mechanism.

As is further shown in FIG. 1, a damping unit 30 is arranged on the guide rail 22, which damping unit can be activated by means of the activator 6 when the shelf 34 travels to its end position in the furniture body or the useful space of the domestic appliance.

It can also be considered to provide the arrangement of a self-retracting apparatus or a combined self-retracting and damping apparatus, with which the shelf 34 is preferably drawn to its end position in the furniture body or in the useful space of the domestic appliance.

The sliding-pivoting mechanism further comprises a locking mechanism which is arranged on the guide rail 22 and on one of the pivot arms 15, 16 and can be activated by the activator 6 fixed to the running rail 1.

The locking mechanism prevents a pivoting movement of the sliding-pivoting mechanism in a lifted and a lowered end position of the sliding-pivoting mechanism.

The locking mechanism may consist of or include a web 18 which is retained in a pivotable and resilient manner on one of the pivot arms 15, 16 and on which a pin 19 is provided which protrudes in the direction of the guide rail 22.

The web 18 is preferably pivotably held via a rotating pin 21 on the pivot arm 15. A spring element 20 is used for resilient retaining, which spring element rests on the one hand on the web 18 and on the other hand on the pivot arm 15.

The pin 19 is in operative connection with a guide element 17. Said guide element 17, which is shown by way of example in FIG. 6, substantially consists of a plate-shaped element, having an edge formed as a guide track 28 which is limited by two locking grooves 23, 24.

The locking positions of the locking mechanism are the positions in which the pin 19, which is arranged on the resiliently retained web 18, rests in one of the two locking grooves 23, 24.

Figure 2:
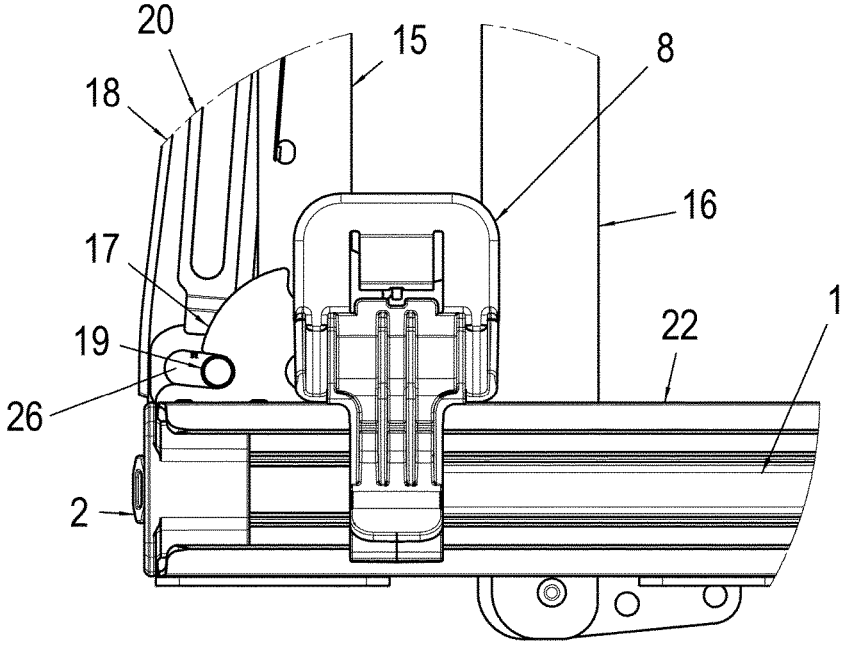

The bottom locking position is shown in FIGS. 1 and 2.

The first pivot arm 15 further comprises an end 25 which extends perpendicularly to the longitudinal axis of the first pivot arm 15 for the guidance of the pin 19 and has a guide groove 26 through which the pin 19 extends.

Figure 3:
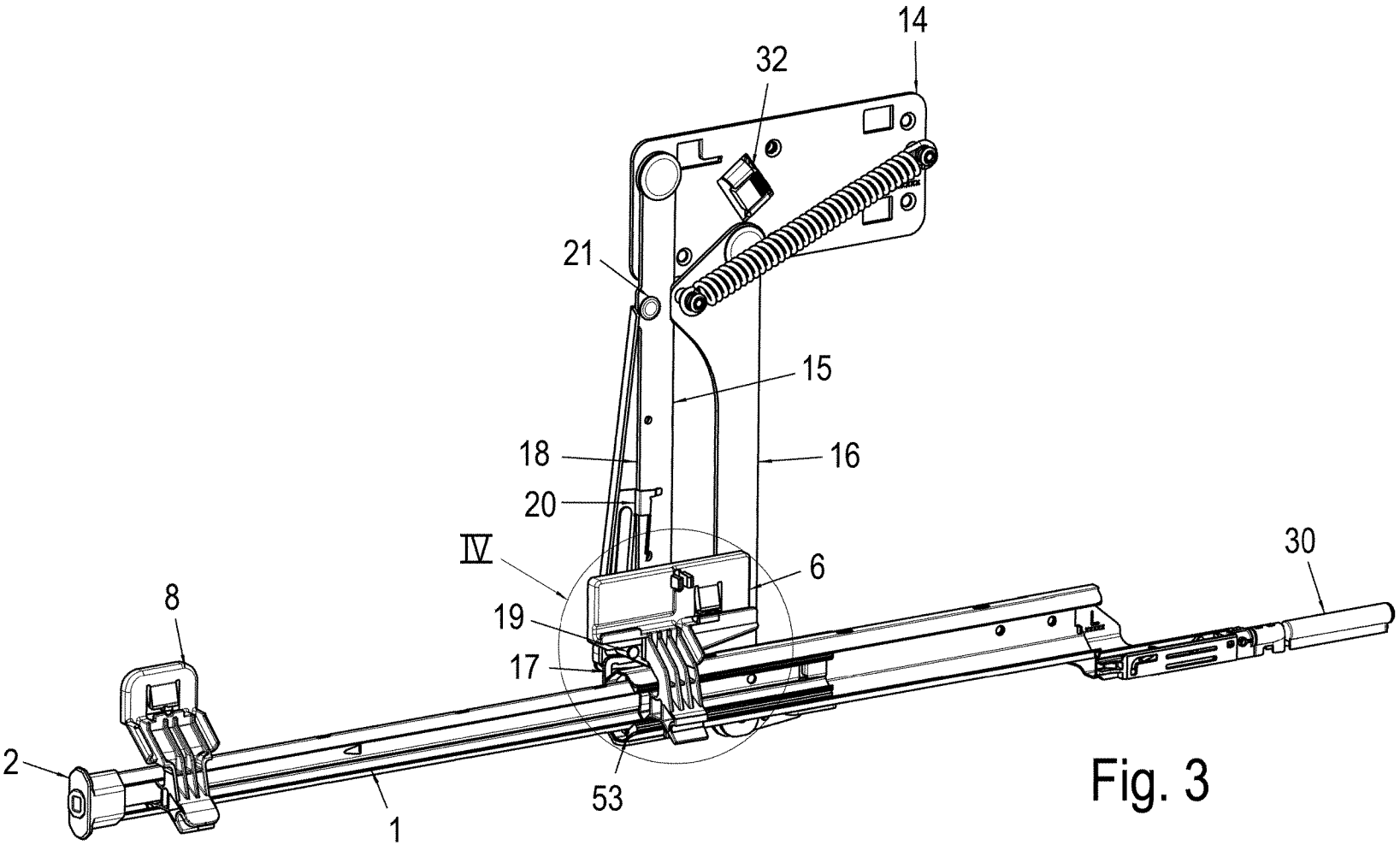
FIGS. 3 and 4 show a perspective view of the sliding-pivoting mechanism of FIG. 1 after the completed displacement of the running rail from the guide rail prior to lifting the sliding-pivoting mechanism and a detailed view of the region designated with IV in FIG. 3.
Figure 4:
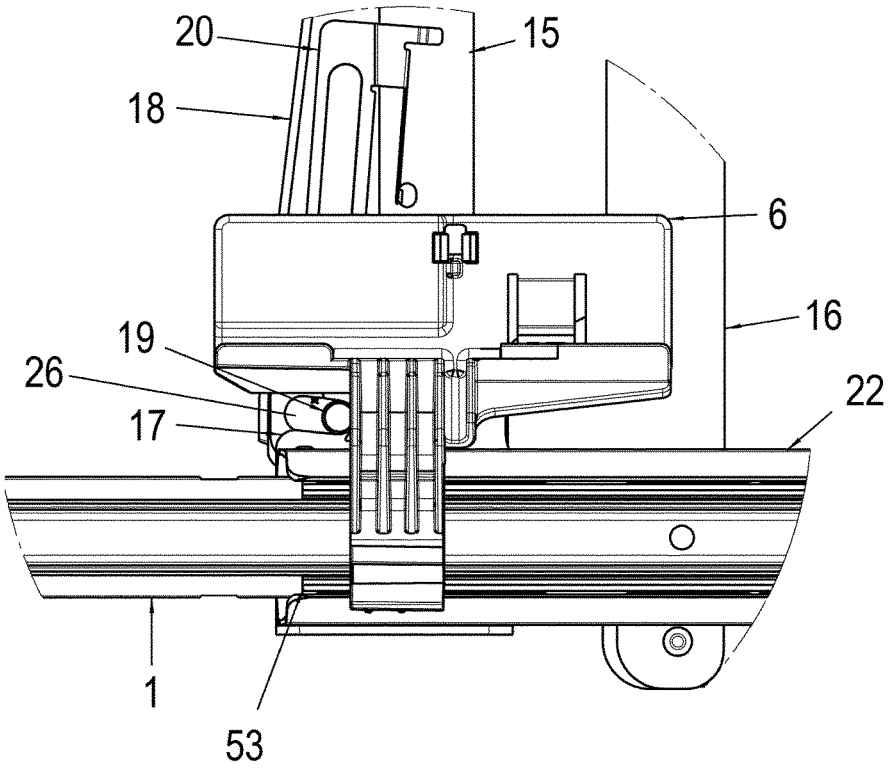

As is shown in FIGS. 3 and 4, the activator 6 comprises a first stop 7 with which the pin 19, during extension of the running rail 1 in a pull-out direction A, can be moved out of a position in the first locking groove 23 which blocks a pivoting movement of the pivot arms 15, 16.

Figure 5:
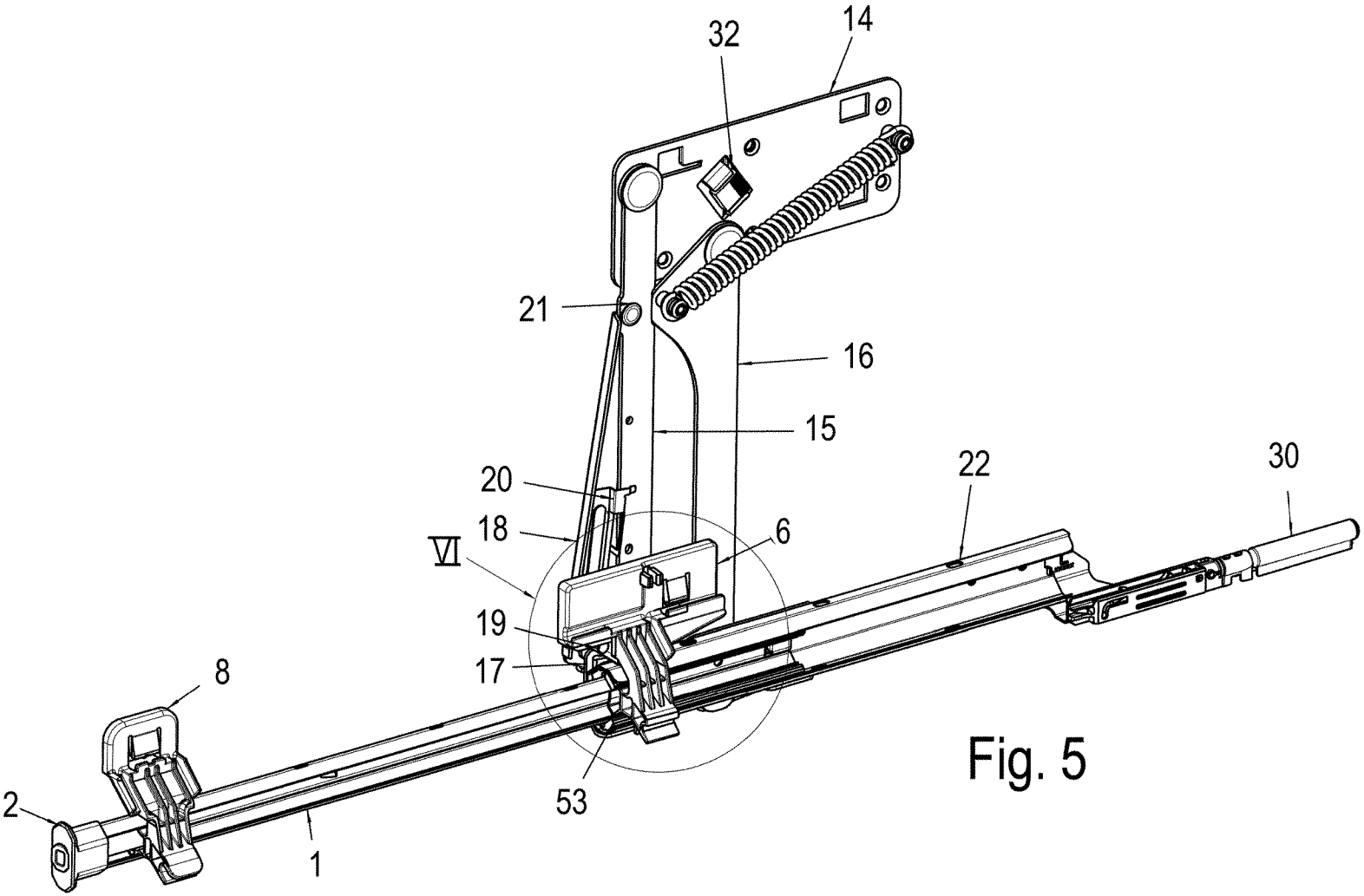
Figure 6:
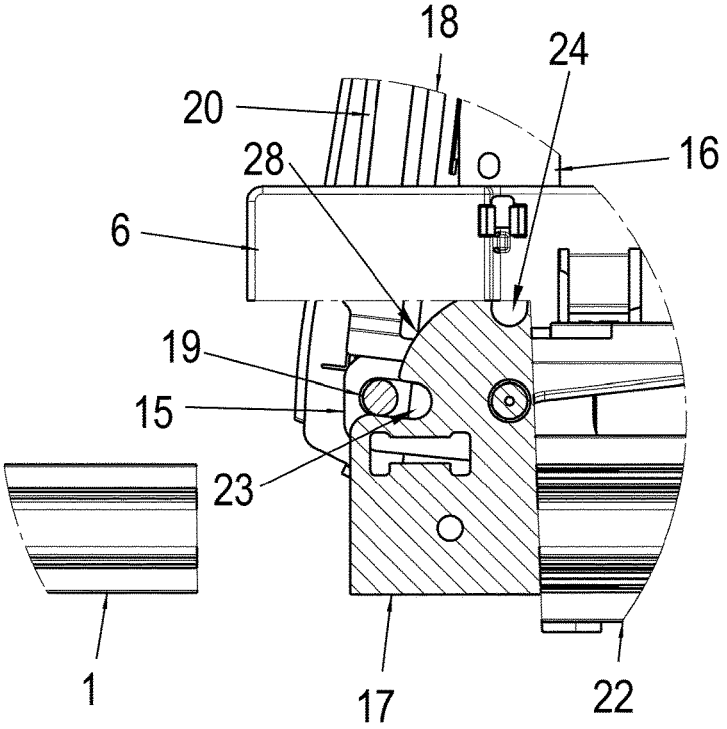

The position of the running rail 1 and the activator 6 as shown in FIGS. 5 and 6 and the position of the pin 19 shown in FIG. 6 show the release position of the locking mechanism, in which pivoting of the pivot arms 15, 16 is now possible.

Figure 7:
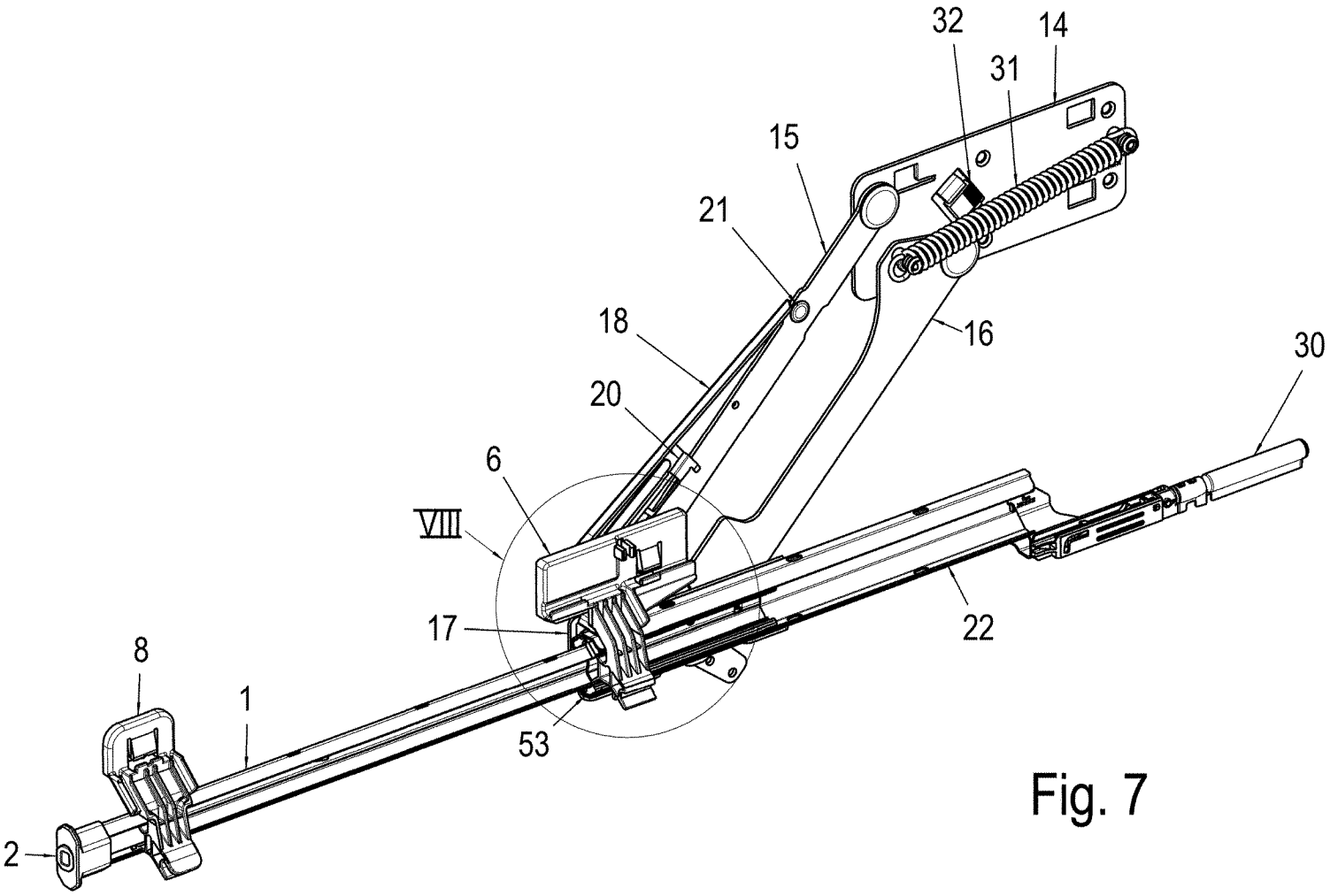
Figure 8:
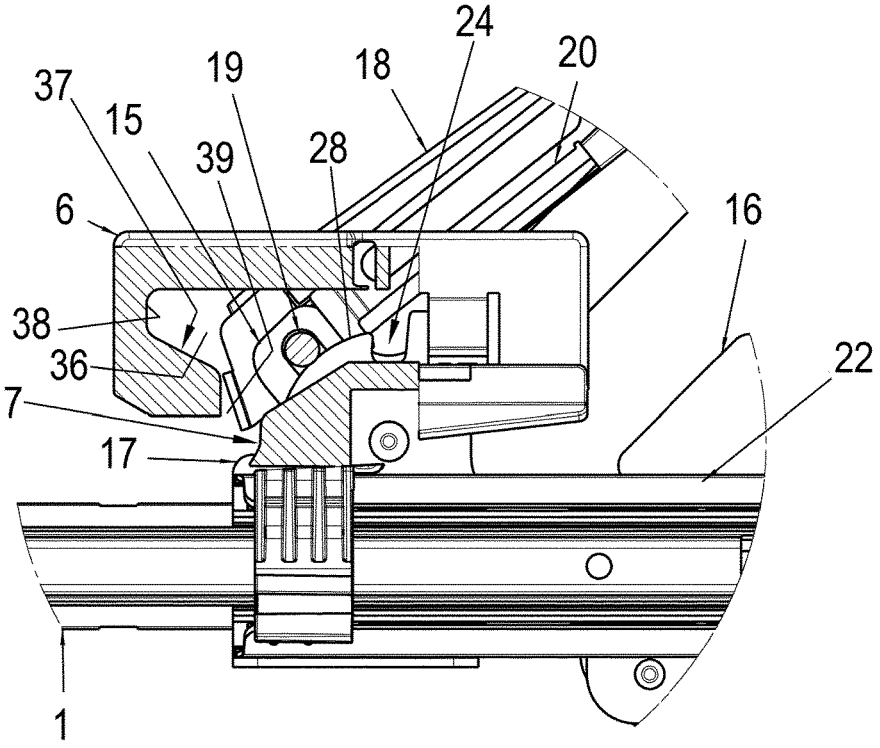

A partly lifted position of the sliding-pivoting mechanism is shown in FIGS. 7 and 8. In this position, the running rail 1 is completely pushed out of the guide rail 22 in the forward direction.

As is shown in FIG. 8, the pin 19 is guided during the lifting process by the stop 7 through an inlet region 39 of a cavity 36 within the activator 6 along a guide track 28 of the guide element 17. As is further shown in detail in FIG. 8, the pin 19 does not rest on any of the inner edges 37, 38 delimiting a cavity 36 of the activator 6 during the pivoting movement of the pivot arms 15, 16.

As a result of the pin 19 resting on the guide curve 28, the web 18 which is resiliently held on the first pivot arm 15 is deflected against the spring force from its idle position in relation to the first pivot arm 15.

Figure 9:
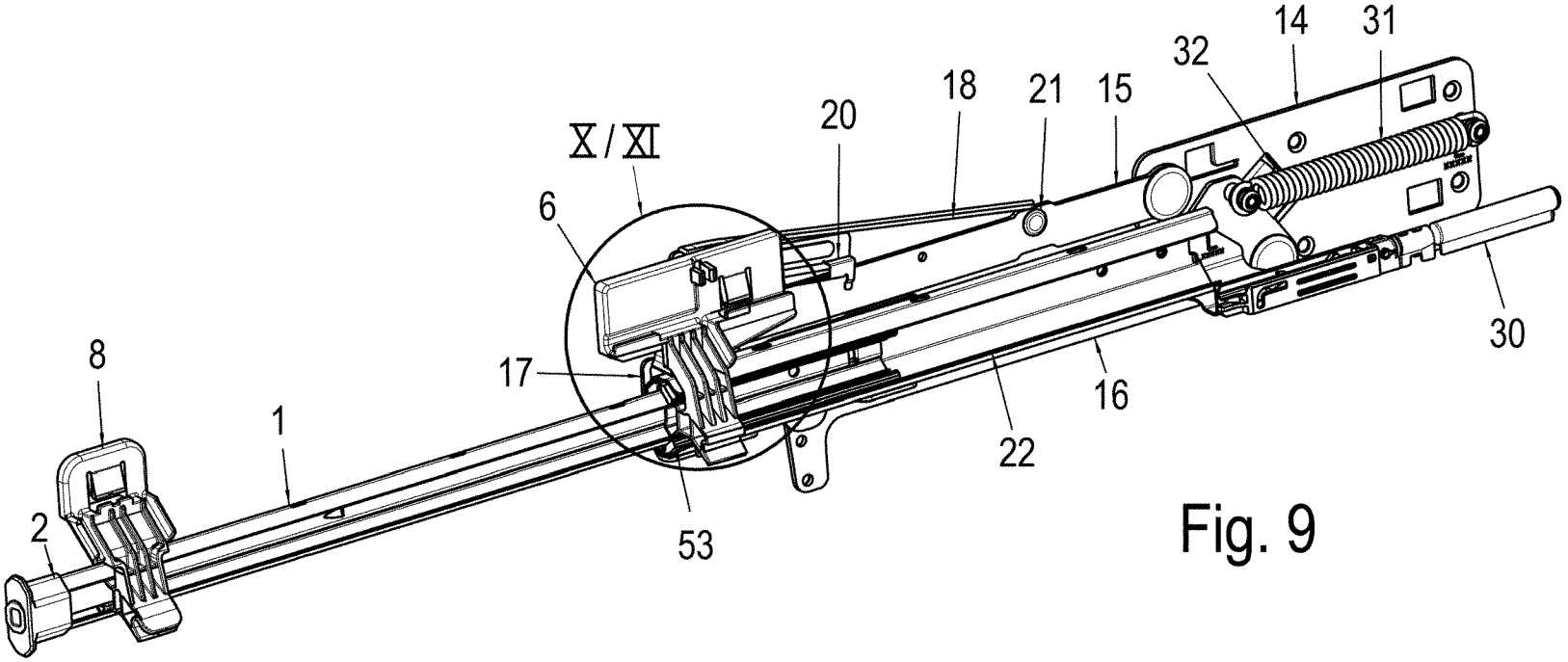
Figure 10:
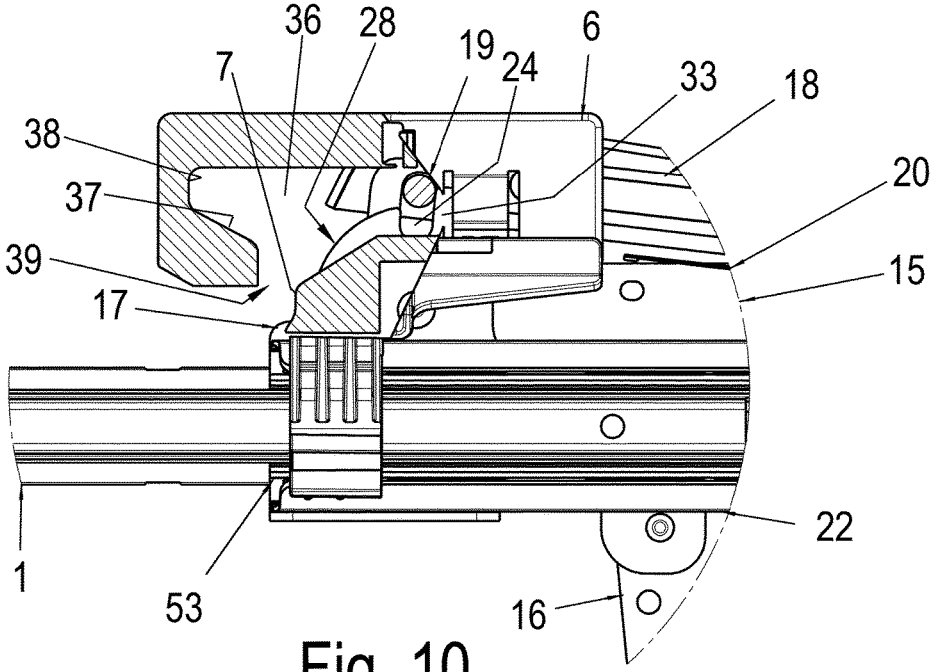
Figure 11:
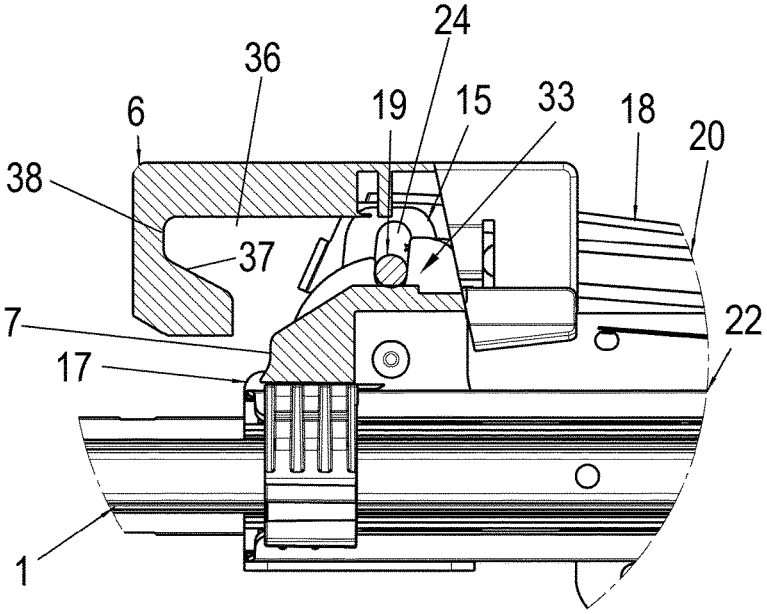
FIG. 11 shows an illustration of the sliding-pivoting mechanism corresponding to FIG. 10, but in the state locked in the second locking position.

FIGS. 9 to 11 show the position of the sliding-pivoting mechanism in which the pivot arms 15, 16 have reached their upper end position.

FIG. 10 shows the pin 19 directly above the second locking groove 24, which may be provided with an elevated stop 33 on its side facing away from the guide track 28, on which the pin 19 strikes.

As a result of the spring force of the web 18, the pin 19 is drawn or pressed in this position in the downward direction into the second locking groove 24. In this upper locking position as shown in FIG. 11, a pivoting movement of the pivot arms 15, 16 is not possible, so that in this position the shelf 34 has reached its upper loading or unloading position.

Figure 12:
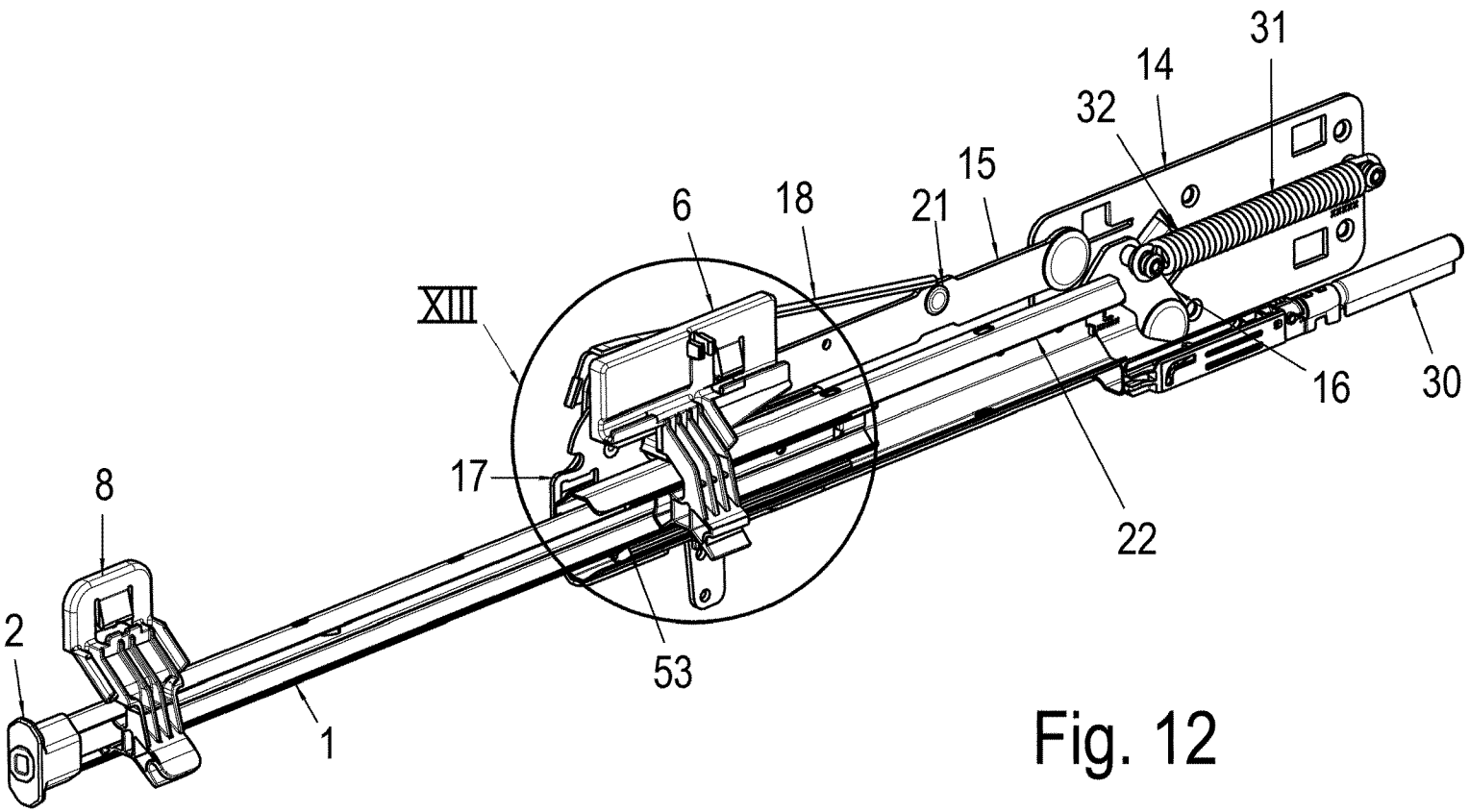
Figure 13:
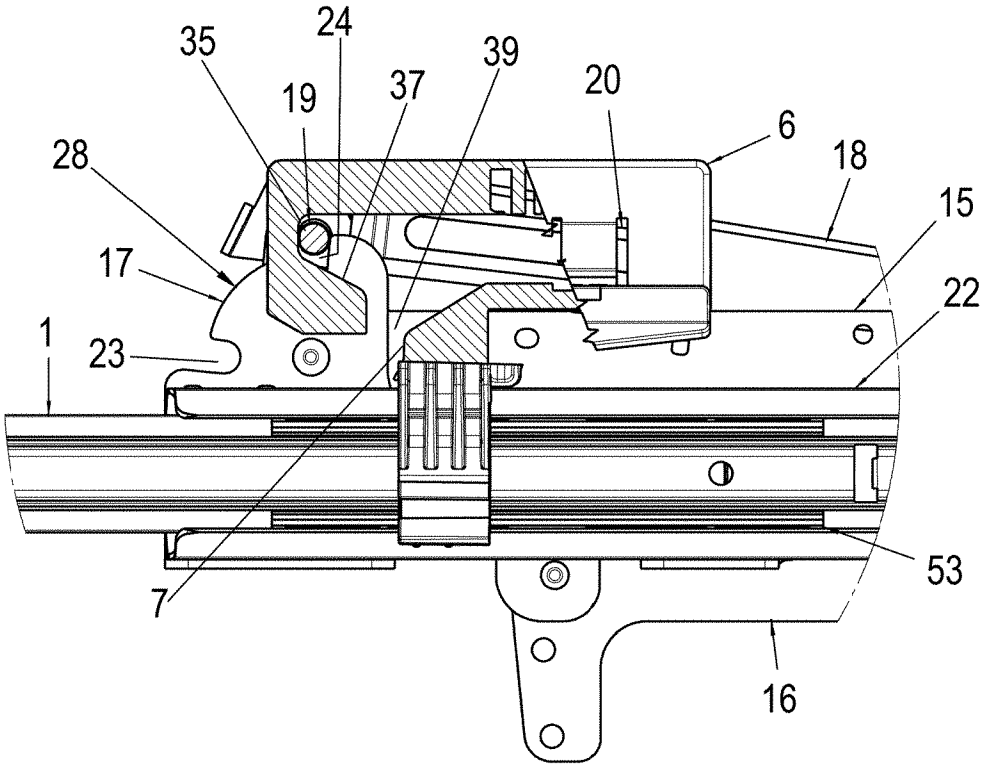

If the shelf 34 is to be returned to the furniture body or the useful space of the domestic appliance again after the completed loading or unloading, it is necessary, as shown in FIGS. 12 and 13, to push the shelf 34 and thus the running rail 1 at first slightly against the pull-out direction A towards the furniture body or the useful space of the domestic appliance.

In this process, the activator 6 is pressed with an inner edge 37, which ascends in an oblique manner to a vertically extending inner edge 35 and is provided on an edge of the cavity 36 on the pull-out side, against the pin 19 and thus lifts the pin 19 out of the second locking groove 24 during the further movement of the activator 6 against the pull-out direction A.

As a result, the pivoting movement of the pivot arms 15, 16 is released again so that the shelf 34 and thus the sliding-pivoting mechanism can now be displaced downwardly again until the pin 19 is pushed into the bottom first locking groove 23 again and the shelf 34, together with the running rail 1, can be moved completely into the furniture body or into the useful space of the domestic appliance again.

In an alternative embodiment, which is shown in FIGS. 14 and 15*a* to 15*g*, the curved guide is formed in such a way that the locking mechanism can be unlocked by a pull-out movement of the running rail 1 in the pull-out direction A from the locking position securing the lifted end position.

Figure 14:
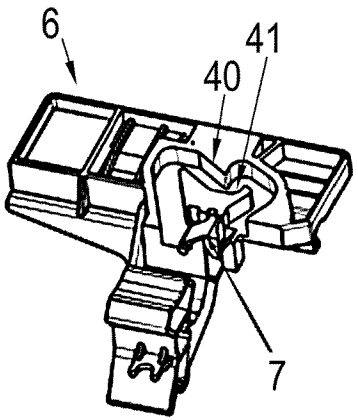
FIG. 14 shows a perspective view of an alternative embodiment of a sliding-pivoting mechanism in accordance with the disclosure with an alternatively formed activator in the fully lowered position.

In this embodiment, as shown in FIG. 14, the activator 6 is preferably provided with a curved guide formed as a cardioid 40. The first stop 7 is integrally attached to the activator 6 directly beneath the cardioid 40 as described above, with which the pin 19 can be moved from a position blocking a pivoting movement of the pivot arms 15, 16 in the first locking groove 23 during extension of the running rail 1 in the pull-out direction A.

Figure 15A:
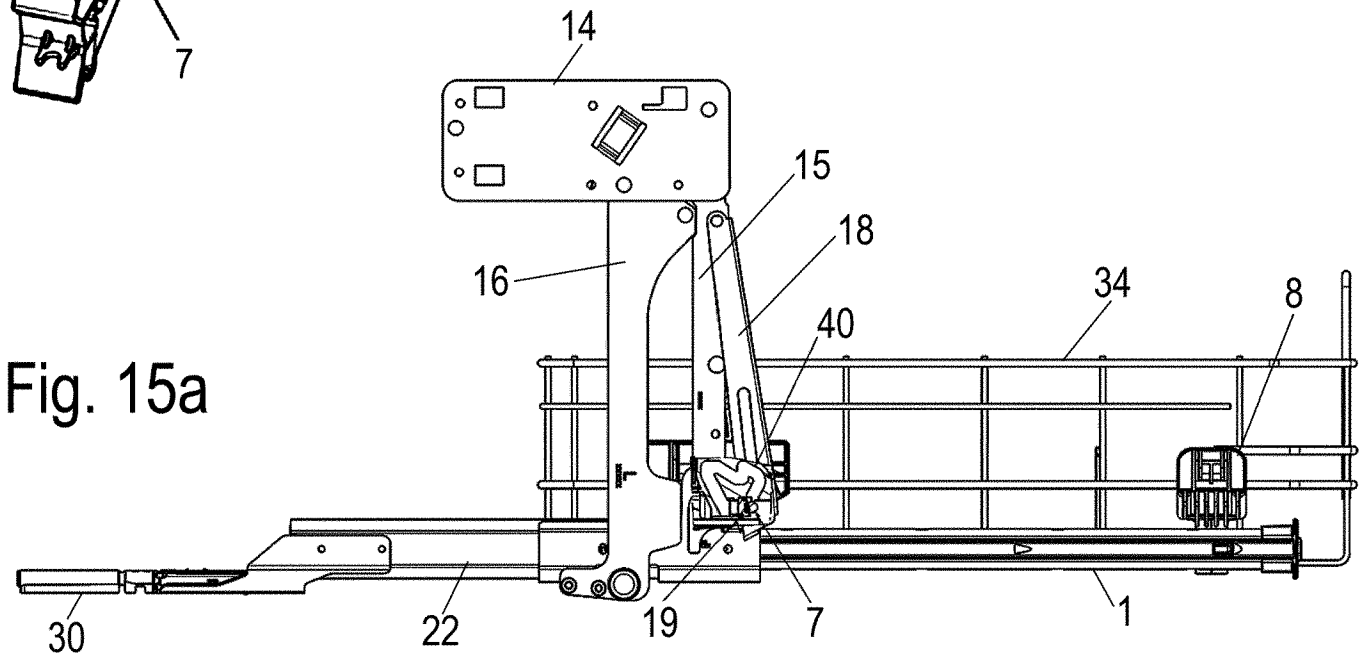
FIGS. 15*a* to 15*g* show perspective views of the sliding-pivoting mechanism according to FIG. 14 in different positions for illustrating the sequence of lifting and lowering the sliding-pivoting mechanism.

The unlocked position of the pin 19 is shown in FIG. 15*a*, in which the shelf 34 is still in the bottom lowered position, but has already been pulled out of the furniture body (not shown) or useful space of the domestic appliance in the pull-out direction A.

Figure 15B:
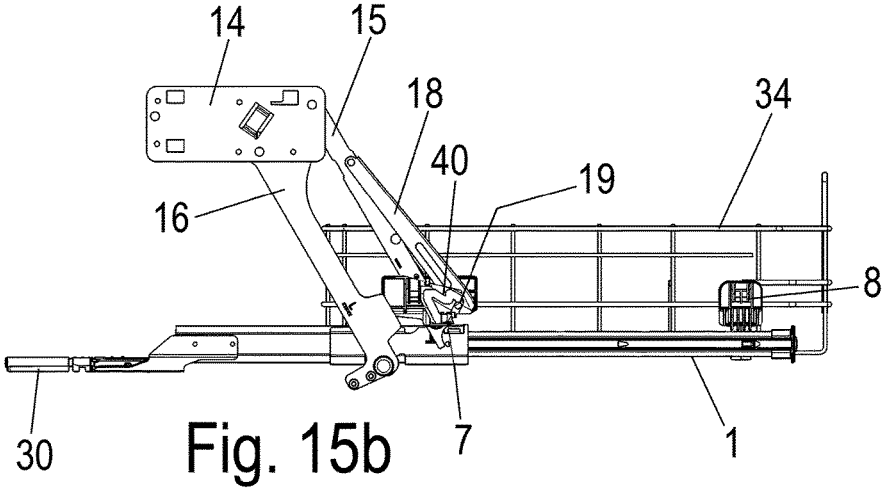
Figure 15C:
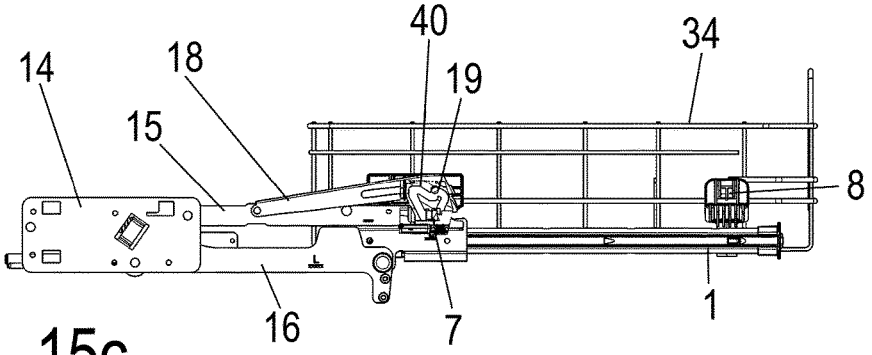
Figure 15D:
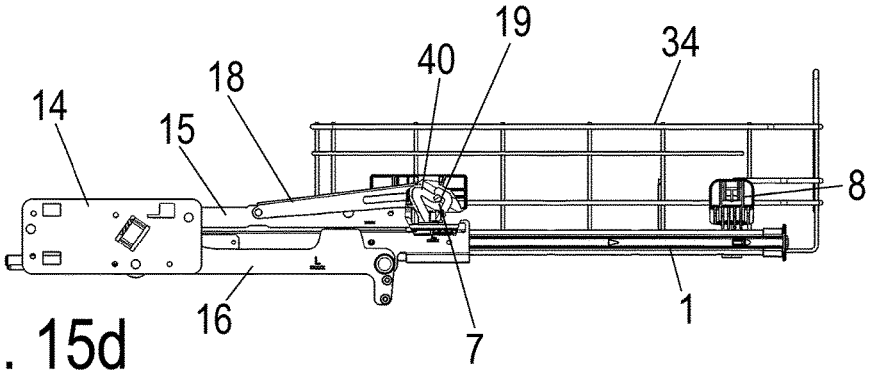
Figure 15E:
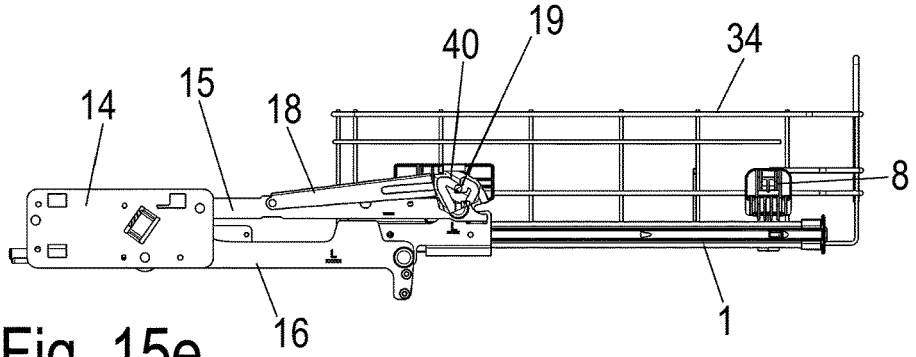

During the subsequent, upward pivoting of the pivot arms 15, 16, the pin 19 enters a region of the cardioid 40 which is disposed at the front as seen in the pull-out direction A, as shown in FIG. 15*b*. During the continued pivoting of the pivot arms 15, 16 to the horizontal position in which the shelf 34 has reached its maximum lifted position, the pin 19 moves past the first curve of the cardioid 40 and is thus pressed by the web 18, which is resiliently held on the first pivot arm 15, into the locking position in the second locking groove 24 and thus also pressed into a central depression 41 of the cardioid 40. The shelf 34 is thus secured in the lifted position against pivoting of the sliding-pivoting mechanism.

In order to pivot the shelf 34 back to its lowered position after the completed loading or unloading, the shelf 34 is moved together with the running rail 1 and the activator 6 by a short distance in the pull-out direction A.

Figure 15F:
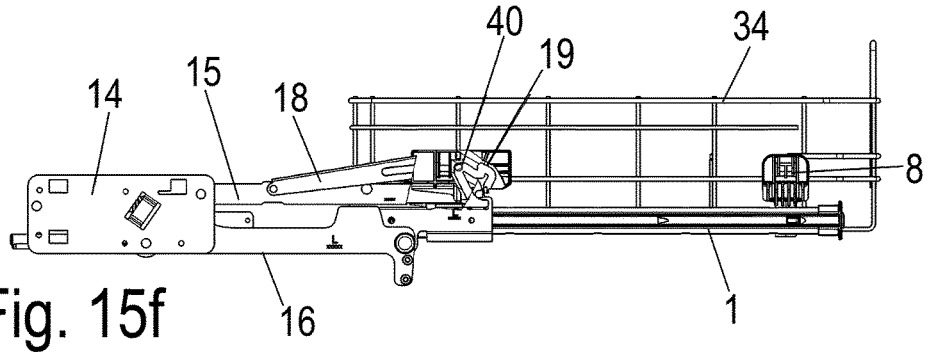

In this process, the pin 19 is pressed out of the second locking groove 24 by the portion of the cardioid 40 which rises in the pull-out direction A. The pin 19 is moved to the curve of the cardioid 40 which is situated at the back when seen in the pull-out direction A, as shown in FIG. 15*f*.

Figure 15G:
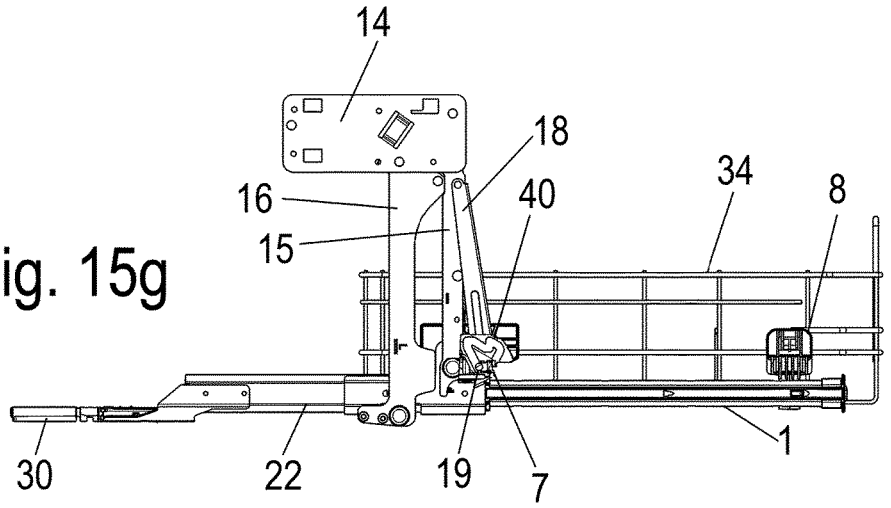

During the subsequent downward pivoting of the shelf 34 to the lower position as shown in FIG. 15*g*, the pin 19 then reaches the bottom position of the cardioid 40 again. During the subsequent insertion of the shelf 34 and thus the activator 6 against the pull-out direction A, the locking bolt 19 is then pushed into the first locking groove 23 so that the shelf 34 is secured against upward pivoting.

A lifting and/or lowering aid 31 is provided on at least one of the side walls or the side wall retainer 14 for supporting the lifting and lowering movement of the shelf 34, with which the pivoting movement of the pivot arms 15, 16 is supported.

The lifting or lowering aid 31 is preferably formed as a tension spring which is fastened to respective pins 27 on the side wall retainer or the side wall on the one hand and on the second pivot arm 16 on the other hand.

In order to prevent a pivoting movement of the pivot arms 15, 16 which goes beyond the upper end position of the pivot arms 15, 16, a limit stop 32 may be provided on the side wall retainer 14 which strikes the second pivot arm 16 upon reaching the upper end position by the second pivot arm 16.

The invention claimed is:

1. A sliding-pivoting mechanism of a shelf of a piece of furniture or domestic appliance for pulling out and lifting the shelf (34) from a body of the piece of furniture or a useful space of the domestic appliance, comprising:

a first pivot arm which is rotatably fixed to at least one of the side walls of the furniture body or the useful space with a first end parallel to the plane of the side walls, a second pivot arm which is rotatably fixed to at least one of the side walls of the furniture body or the useful space with a first end parallel to the plane of the side walls, wherein the pivot arms are arranged in parallel and at a distance from each other, wherein a guide rail is pivotably fastened to the respective second ends of the pivot arms parallel to the plane of the side walls in such a way that the guide rail can be pivoted from a bottom position within the furniture body or the useful space to a lifted, upper position at least partly outside of the furniture body or the useful space, at least one running rail which is linearly displaceable in the guide rail and on which the shelf is fixed, wherein the sliding-pivoting mechanism comprises a locking mechanism, which is arranged on the guide rail and on one of the pivot arms and can be actuated by an activator fixed to the running rail, for preventing a pivoting movement of the sliding-pivoting mechanism in a lifted end position and a lowered end position, wherein the locking mechanism comprises a web, which is resiliently and pivotably held on the first pivot arm, with a pin protruding in the direction of the guide rail, which pin can be guided along a guide element fixed to the guide rail from the locking position securing the lowered end position at least to the locking position securing the lifted end position, wherein the activator fixed to the running rail comprises a curved guide, with which the pin, during the lifting and lowering of the shelf, can be guided from the locking position securing the lowered end position to the locking position securing the lifted end position and vice versa, and wherein the curved guide is formed in such a way that the locking mechanism can be unlocked by a push-in movement against a pull-out direction.

2. A sliding-pivoting mechanism according to claim 1, wherein the guide element comprises respective locking grooves in which the pin rests in the respective locking position, and wherein the locking grooves delimit a guide track of the guide element, along which the pin can be guided from one of the locking positions to the second one of the locking positions.

3. A sliding-pivoting mechanism according to claim 1, wherein the curved guide is formed in such a way that the locking mechanism is automatically locked by a pivoting movement to the lifted end position.

4. A sliding-pivoting mechanism according to claim 1, wherein the curved guide is formed on inner edges which delimit a cavity of the activator, having an inlet region through which the pin can be guided into the cavity.

5. A sliding-pivoting mechanism according to claim 4, wherein a first limit stop extending downwardly in the direction of the running rail is arranged in the region of the inlet region, with which the pin can be moved out from a position blocking a pivoting movement of the pivot arms in the first locking groove when pulling out the running rail in the pull-out direction, and wherein the pin can be guided along the limit stop into the cavity during a subsequent pivoting movement of the pivot arms.

6. A sliding-pivoting mechanism according to claim 4, wherein the pin, during the pivoting movement of the pivot arms, does not rest on any of the inner edges that delimit the cavity of the activator.

7. A sliding-pivoting mechanism according to claim 4, wherein on an edge on the pull-out side the cavity comprises an inner edge ascending obliquely from the inlet region to a vertically extending inner edge, with which the pin can be moved out of a position in the second locking groove which blocks a pivoting movement of the pivot arms-by pushing in the running rail against the pull-out direction.

8. A sliding-pivoting mechanism according to claim 1, wherein the curved guide is formed in such a way that the locking mechanism can be unlocked by a pull-out movement of the running rail in the pull-out direction from the locking position securing the lifted end position.

9. A sliding-pivoting mechanism according to claim 8, wherein the curved guide is formed as a cardioid.

10. A sliding-pivoting mechanism according to claim 1, wherein an end stop for limiting the path of the running rail is formed on an end of the guide rail which is situated at the front in the pull-out direction.

11. A piece of furniture with a furniture body and at least one shelf fixed in the furniture body with a sliding-pivoting mechanism, with which the shelf can be pulled out of and lifted from the furniture body, wherein the sliding-pivoting mechanism is formed according to claim 1.

12. A domestic appliance having at least one shelf fixed to the inner sides of a useful space by a sliding-pivoting mechanism, with which the shelf can be pulled out of and lifted from the useful space, wherein the sliding-pivoting mechanism is formed according to claim 1.

13. A sliding-pivoting mechanism of a shelf of a piece of furniture or domestic appliance for pulling out and lifting the shelf from a body of the piece of furniture or a useful space of the domestic appliance, comprising:

a first pivot arm which is rotatably fixed to at least one of the side walls of the furniture body or the useful space with a first end parallel to the plane of the side walls, a second pivot arm which is rotatably fixed to at least one of the side walls of the furniture body or the useful space with a first end parallel to the plane of the side walls, wherein the pivot arms are arranged in parallel and at a distance from each other, wherein a guide rail is pivotably fastened to the respective second ends of the pivot arms parallel to the plane of the side walls in such a way that the guide rail can be pivoted from a bottom position within the furniture body or the useful space to a lifted, upper position at least partly outside of the furniture body or the useful space, at least one running rail which is linearly displaceable in the guide rail and on which the shelf is fixed, wherein the sliding-pivoting mechanism comprises a locking mechanism, which is arranged on the guide rail and on one of the pivot arms and can be actuated by an activator fixed to the running rail, for preventing a pivoting movement of the sliding-pivoting mechanism in a lifted end position and a lowered end position, wherein the locking mechanism comprises a web, which is resiliently and pivotably held on the first pivot arm, with a pin protruding in the direction of the guide rail, which pin can be guided along a guide element fixed to the guide rail from the locking position securing the lowered end position at least to the locking position securing the lifted end position, wherein the activator fixed to the running rail comprises a curved guide, with which the pin, during the lifting and lowering of the shelf, can be guided from the locking position securing the lowered end position to the locking position securing the lifted end position and vice versa, wherein the curved guide is formed in such a way that the locking mechanism can be unlocked by a pull-out movement of the running rail in a pull-out direction from the locking position securing the lifted end position, and wherein the curved guide is formed as a cardioid.

* * * * *